US010384214B2

(12) United States Patent
Roux et al.

(10) Patent No.: US 10,384,214 B2
(45) Date of Patent: Aug. 20, 2019

(54) ELECTROSTATIC COLLECTOR

(71) Applicant: COMMISSARIAT A L'ENERGIE ATOMIQUE ET AUX ENERGIES ALTERNATIVES, Paris (FR)

(72) Inventors: Jean-Maxime Roux, Grenoble (FR); Roland Sarda Esteve, Fontenay Sous Bois (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 260 days.

(21) Appl. No.: 15/321,589

(22) PCT Filed: Jun. 25, 2015

(86) PCT No.: PCT/EP2015/064344
§ 371 (c)(1),
(2) Date: Dec. 22, 2016

(87) PCT Pub. No.: WO2015/197747
PCT Pub. Date: Dec. 30, 2015

(65) Prior Publication Data

US 2017/0203304 A1 Jul. 20, 2017

(30) Foreign Application Priority Data

Jun. 25, 2014 (FR) ..... 14 55908

(51) Int. Cl.
*B03C 3/06* (2006.01)
*B03C 3/86* (2006.01)
(Continued)

(52) U.S. Cl.
CPC ..... *B03C 3/06* (2013.01); *B03C 3/12* (2013.01); *B03C 3/41* (2013.01); *B03C 3/49* (2013.01);
(Continued)

(58) Field of Classification Search
CPC combination set(s) only.
See application file for complete search history.

(56) References Cited

U.S. PATENT DOCUMENTS 2,199,390 A * 5/1940 Anderson ..... B03C 3/12 313/231.01
2,244,279 A * 6/1941 White ..... B03C 3/40 313/331
(Continued)

FOREIGN PATENT DOCUMENTS

DE 32 34 200 A1 3/1983
DE 3234200 A1 * 3/1983 ..... B03C 3/41
(Continued)

OTHER PUBLICATIONS

U.S. Appl. No. 13/596,254, filed Aug. 28, 2012, 2013/0047847 A1, Jean-Maxime Roux.
(Continued)

*Primary Examiner* — Amber R Orlando
*Assistant Examiner* — Sonji Turner
(74) *Attorney, Agent, or Firm* — Oblon, McClelland, Maier & Neustadt, L.L.P.

(57) ABSTRACT

An electrostatic collector including: a collection chamber delimited by a tubular wall oriented along a first axis; a collection electrode configured to be disposed inside the collection chamber against the wall; a discharge electrode, of elongate form, that extends along the first axis and includes an end, in a shape of a tip, the end being disposed opposite the collection electrode; a first part of a first diameter, emerging on the tip-shaped end, a second part of a second diameter, the second diameter being greater than or equal to twice the first diameter, the second diameter for
(Continued)

example being between 2 and 6 times the first diameter; and a sudden widening, extending between the first part and the second part.

17 Claims, 6 Drawing Sheets

(51) Int. Cl.
*B03C 3/49* (2006.01)
*B03C 3/12* (2006.01)
*B03C 3/41* (2006.01)

(52) U.S. Cl.
CPC ..... *B03C 3/86* (2013.01); *B03C 2201/06* (2013.01); *B03C 2201/08* (2013.01); *B03C 2201/28* (2013.01)

(56) References Cited

U.S. PATENT DOCUMENTS 3,400,513 A * 9/1968 Boll ..... B03C 3/12 55/DIG. 38
3,495,379 A * 2/1970 Hall ..... B03C 3/41 55/DIG. 38
4,533,368 A 8/1985 Snaddon et al.
5,395,430 A * 3/1995 Lundgren ..... B03C 3/06 96/83
9,333,513 B2 * 5/2016 Muller ..... B03C 3/41
9,962,713 B2 * 5/2018 Roux ..... B03C 3/41

FOREIGN PATENT DOCUMENTS

| | | | |
|---|---|---|---|
| EP | 2 266 702 | A1 | 12/2010 |
| FR | 25 527 | | 3/1923 |
| FR | 944 547 | A | 4/1949 |
| FR | 976 521 | A | 3/1951 |
| FR | 1.547.889 | A | 11/1968 |
| GB | 413800 | A | 7/1934 |

OTHER PUBLICATIONS

U.S. Appl. No. 13/700,366, filed Nov. 27, 2012, 2013/0118479 A1, Jean-Francois Fourmigue et al.
U.S. Appl. No. 15/021,594, filed Mar. 11, 2016, 2016/0221004 A1, Jean-Maxime Roux.
U.S. Appl. No. 15/113,136, filed Jan. 26, 2015, Cedric Michel, et al.
International Search Report dated Aug. 28, 2015 in PCT/EP2015/064344 filed Jun. 25, 2015.
French Search Report dated Mar. 12, 2015 in French Application 1455908 filed Jun. 25, 2014.

* cited by examiner

ELECTROSTATIC COLLECTOR

TECHNICAL FIELD

This invention relates to an electrostatic device for collecting particles in suspension in a gaseous medium, often called an electrostatic collector or electro-filter.

PRIOR ART

Detection and analysis of particles present in ambient air is a major concern at the present time, either for monitoring air quality, for protecting populations against air-borne pathogenic agents (legionella, influenza, etc.) or for security challenges (detection of biological attacks).

Electrostatic collectors or electro-filters, often referred to as ESPs (Electrostatic Precipitators), can collect particles in suspension in a gaseous medium, for example ambient air. They can thus be used to purify the gaseous medium and possibly analyse collected particles.

An electrostatic collector comprises two electrodes located close to each other. One of the two electrodes is often referred to as the discharge electrode and the other electrode is often referred to as the counter-electrode or the collection electrode. A strong electric field is induced between the two electrodes under the effect of the potential difference applied between the two electrodes. The electric field ionises the gas volume located between the two electrodes, creating a duct or ring of ionised gas around the discharge electrode. This phenomenon is called a corona discharge. The gas containing the particles to be separated forced to transit between the discharge electrode and the collection electrode then passes through an ion flux and the particles to be separated are ionised in turn. Under the effect of electrostatic forces, the charged particles thus created are attracted by the collection electrode on which they are collected.

The problem arises of being able to optimise the electric discharge generated between the discharge electrode and the collection electrode in order to maximise the collection efficiency.

DESCRIPTION OF THE INVENTION

This invention is aimed particularly at solving these problems.

This invention relates to an electrostatic collector comprising a collection chamber, delimited by a tubular wall oriented along a first axis; a discharge electrode, of elongate form, extending along said first axis; and a collection electrode intended to be positioned inside the collection chamber against the wall.

According to one embodiment of this invention, the discharge electrode comprises:

- one end, in the shape of a tip, said end being positioned facing the collection electrode;
- a first part, referred to as the slender part, having a first diameter and emerging onto said tip-shaped end;
- a second part having a second diameter, the second diameter being greater than or equal to twice the first diameter, the second diameter preferably being between 2 and 6 times the first diameter; and
- a sudden widening, extending between the first and second parts.

According to one embodiment of this invention, said sudden widening extends over a distance that is less than the second diameter.

The first part can have a length of less than about 10 mm, preferably less than about 5 mm, for example between about 1 and 5 mm.

According to one embodiment of this invention, the electrostatic collector further comprises a first polarising means, capable of bringing the discharge electrode to a first potential, and a second polarising means, capable of bringing the collection electrode to a second potential, the first potential being less than the second potential. Preferably, the first potential is a ground potential.

The first diameter can be between 0.5 mm and 2 mm.

The second diameter can be between 1 mm and 5 to 6 mm.

One advantage of a discharge electrode having such a sudden widening lies in the fact that it is used to obtain a more axisymmetric deposition of particles on the collection electrode, in relation to a discharge electrode with a constant diameter throughout its length. Such a discharge electrode prevents inhomogeneous accumulations of particles collected at the level of the collection electrode. This results in an enhanced collection efficiency of the electrostatic collector.

According to one embodiment of this invention, the widening of the discharge electrode is formed by a conducting ring surrounding the first slender part of the discharge electrode over a part of its length, said tip-shaped end protruding from the ring.

Advantageously, the end of the ring the closest to the tip-shaped end of the discharge electrode is rounded.

Said tip-shaped end can be located at a distance of between 2 mm and 10 mm from the ring.

The ring can have an outer diameter of between 1 mm and 5 mm and an inner diameter allowing for the passage and support of the first slender part of the discharge electrode.

According to one embodiment of this invention, the discharge electrode is a hollow electrically conducting element, for example a metal capillary tube. One advantage of a hollow discharge electrode lies in the fact that it can be manufactured using a method that is easy to implement. Simply cut an electrically conducting tube to obtain a hollow discharge electrode. In order to obtain a tip, machine the end of the discharge electrode into the shape of a tip. Another advantage of a hollow discharge electrode lies in the fact that it provides for lower electrical discharges than a tip of similar dimensions.

According to one embodiment of this invention, the discharge electrode and the collection electrode are offset in relation to each other along said first axis of the collection chamber, no portion of the discharge electrode being at the same level as the collection electrode along said first axis.

This invention further relates to an electrostatic collector comprising a collection chamber, delimited by a tubular wall oriented along a first axis; a discharge electrode, at least one end of which has a tip shape, intended to be positioned inside the collection chamber; a collection electrode, tubular in shape, intended to be positioned inside an opening formed in the wall, the collection electrode having a first end and a second end, the first end being intended to be positioned the closest to said tip-shaped end of the discharge electrode; and a return means, intended to be positioned inside said opening between the collection electrode and the wall.

One advantage of such an electrostatic collector lies in the fact that it allows the collection electrode to be easily removed from the electrostatic collector, for example in order to analyse the particles collected and/or clean the collection electrode.

The return means can be a spring.

According to one embodiment of this invention, the electrostatic collector further comprises a locking part, intended to press against the second end of the collection electrode and compress the return means. Preferably, the second end of the collection electrode comprises a flange.

Advantageously, the first end of the collection electrode has a rounded inner edge. This reduces the risk of generating electric arcs between the discharge electrode and the collection electrode.

According to one embodiment of this invention, the inner wall of the collection electrode is a portion of a cone.

According to one embodiment of this invention, the collection chamber has an inner diameter that is greater upstream of the collection electrode than at the location of the collection electrode.

This invention further relates to a method for using an electrostatic collector according to the invention, as described hereinabove.

This invention further relates to a method for using an electrostatic collector comprising:

- a collection chamber delimited by a tubular wall oriented along a first axis;
- a discharge electrode, of elongate form, extending along said first axis; and a collection electrode positioned inside the collection chamber, the discharge electrode having a tip-shaped end positioned facing the collection electrode; and
- a first polarising means, capable of bringing the discharge electrode to a first potential, and a second polarising means, capable of bringing the collection electrode to a second potential;
- the method being such that the first potential is less than the second potential.

Preferably, the first potential is a ground potential.

This invention further relates to an electrostatic collector comprising:

- a collection chamber delimited by a tubular wall oriented along a first axis;
- a discharge electrode, of elongate form, extending along said first axis; and a collection electrode positioned inside the collection chamber, the discharge electrode having a tip-shaped end positioned facing the collection electrode; and
- a first polarising means, capable of bringing the discharge electrode to a first potential, and a second polarising means, capable of bringing the collection electrode to a second potential,
- the electrostatic collector being characterised in that the first potential is less than the second potential.

Preferably, the first potential is a ground potential.

BRIEF DESCRIPTION OF THE FIGURES

Other features and advantages of the invention will be better understood upon reading the following description, with reference to the appended figures, provided for illustrative purposes only and in no way limiting the scope of the invention.

Identical, similar or equivalent parts of the different figures carry the same numerical references in order to ease the passage from one figure to another.

The different parts shown in the figures are not necessarily displayed according to a uniform scale in order to make the figures easier to read.

DETAILED DESCRIPTION OF THE SPECIFIC EMBODIMENTS

Figure 1:
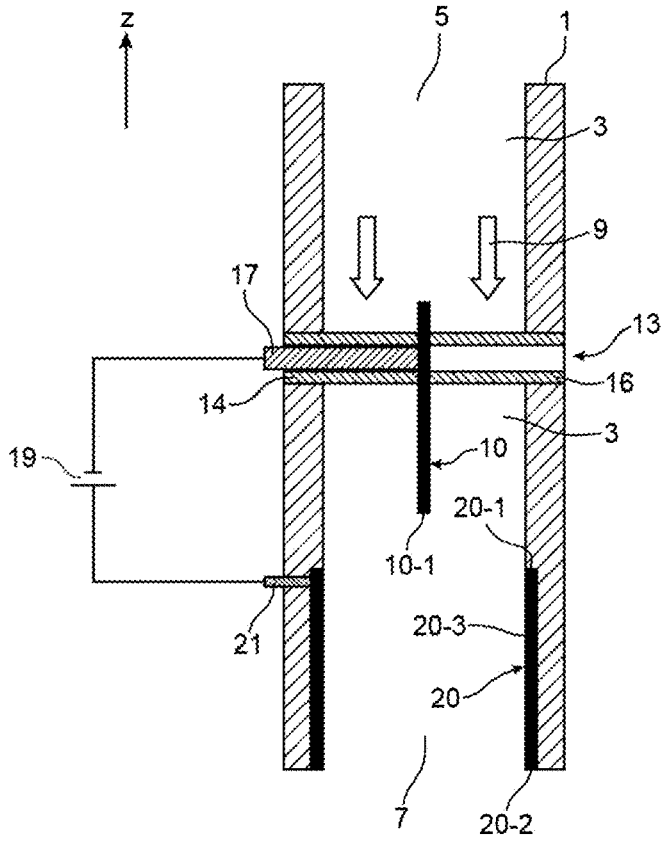
FIG. 1 is a cross-sectional view illustrating in a schematic manner one example embodiment of an electrostatic collector.

FIG. 1 is a cross-sectional view illustrating in a schematic manner one embodiment of an electrostatic collector.

A tubular wall 1, for example a cylinder of revolution, delimits a collection chamber 3. The longitudinal axis of the wall 1 is oriented along the z-axis. The wall 1 is preferably made from an electrically insulating material.

During operation, the electrostatic collector is intended to be oriented such that the z-axis corresponds to the vertical direction or to an inclined direction with regard to the vertical. The wall 1 comprises an upstream end and a downstream end respectively delimiting an inlet 5 and an outlet 7 of the collection chamber. The terms "upstream", "downstream", "inlet", and "outlet" are considered relative to the direction of the gas flow in the electrostatic collector, symbolised by arrows 9. The gas to be treated flows in the upstream to downstream direction, from the inlet 5 to the outlet 7 of the electrostatic collector.

The device comprises a plenum (not shown), for allowing the gas to be treated to enter the device, positioned upstream of the collection chamber 3. The plenum and the collection chamber are preferably coaxial.

A discharge electrode 10, of elongate form, comprising at least one electrically conducting material, is held in the collection chamber 3 by a support 13. In a general manner, the discharge electrode 10 is advantageously formed from a hollow electrically conducting element, for example a metal capillary tube.

One advantage of a hollow discharge electrode lies in the fact that it can be manufactured using a method that is easy to implement. Simply cut an electrically conducting tube to obtain a hollow discharge electrode. In order to obtain a tip, machine the end of the discharge electrode into the shape of a tip. Another advantage of a hollow discharge electrode lies in the fact that it provides for lower electrical discharges than a tip of similar dimensions.

The discharge electrode 10 is preferably positioned along the z-axis of the collection chamber.

The support 13, for example a ring, the two ends 14, 16 of which are secured to the wall 1, passes transversally through the collection chamber. The longitudinal axis of the support 13 is oriented perpendicular to the longitudinal axis (z-axis) along which the tubular wall 1 extends. The support 13 is preferably made from an insulating material. The support 13 comprises a through opening, for example cylindrical, the longitudinal axis of which is parallel to the z-axis. Said opening is configured to hold the discharge electrode 10. The longitudinal axis of the discharge electrode 10 is oriented along the z-axis.

The discharge electrode 10 is in contact with a polarising means 17, comprising at least one electrically conducting part, which is used to electrically connect the former to a voltage generator 19.

A collection electrode 20, tubular in shape, for example cylindrical, comprising at least one electrically conducting material, is positioned inside the collection chamber 3, in contact with the inner surface of the wall 1. The collection electrode 20 is positioned within an opening formed in the wall 1 of the collection chamber. The collection electrode 20 and the wall 1 are coaxial. The collection electrode 20 is intended to form the particle collection surface. Advantageously, the inner diameter of the collection electrode 20 is substantially equal to the inner diameter of the wall 1 to reduce the diameter discontinuities of the collection chamber over the gas flow path.

The collection electrode 20 is in contact with a polarising means 21, comprising at least one electrically conducting part, which is used to electrically connect the former to the voltage generator 19.

The support 13 is, for example, positioned in the collection chamber such that the discharge electrode 10 is located upstream of the collection electrode 20, as shown in FIG. 1. In this case, the end 10-1 of the discharge electrode 10 the closest to the collection electrode 20 corresponds to its downstream end. The end 20-1 of the collection electrode 20 the closest to the discharge electrode 10 corresponds to its upstream end and the end 20-2 of the collection electrode 20 the furthest away from the discharge electrode 10 corresponds to its downstream end. Preferably, the discharge electrode 10 and the collection electrode 20 are offset in relation to each other along the z-axis of the collection chamber, no portion of the discharge electrode 10 being at the same level as the collection electrode 20 along the z-axis. The downstream end 10-1 of the discharge electrode 10 and the upstream end 20-1 of the collection electrode 20 are separated by a certain distance (or offset) along the z-axis, the downstream end 10-1 of the discharge electrode 10 being located upstream of the upstream end 20-1 of the collection electrode 20.

The downstream end 10-1 of the discharge electrode 10 the closest to the collection electrode 20 is free. This end has a tip shape, which allows for the formation of corona discharges between the discharge electrode (which has the lowest radius of curvature) and the collection electrode (which has the highest radius of curvature). The downstream end 10-1 of the discharge electrode 10 has, for example, a radius of curvature of less than about 1 mm, hence the term "tip-shaped".

Preferably, the distance between the downstream end 10-1 of the discharge electrode 10 and the upstream end 20-1 of the collection electrode 20 is greater than or equal to the inner radius of the collection chamber. This reduces the risk of electric arc formation between the discharge electrode and the collection electrode.

Advantageously, the distance between the downstream end 10-1 of the discharge electrode and the upstream end 20-1 of the collection electrode is three to four times less than the inner radius of the collection chamber. This optimises the collection efficiency.

Preferably, the free downstream end 10-1 of the discharge electrode, the place of discharge, is offset from the upstream end 20-1 of the collection electrode 20 by a distance, along the z-axis, between the inner radius of the collection electrode and the inner diameter of the collection electrode, for example with a tolerance of 1 mm, the downstream end 10-1 of the discharge electrode 10 being located upstream of the upstream end 20-1 of the collection electrode 20.

For a collection electrode having an inner diameter of about 10 mm, the offset between the downstream end 10-1 of the discharge electrode 10 and the upstream end 20-1 of the collection electrode 20 along the z-axis is, for example, between about 5 mm (for example to +/−1 mm) and about 10 mm (for example to +/−1 mm), for example about 7 mm.

Advantageously, the inner diameter of the collection chamber is less than about 30 mm.

Discharge Electrode

Advantageously, the discharge electrode 10 has a widening upstream of its downstream end 10-1.

The discharge electrode 10 widens from a first diameter to a second diameter, for example corresponding to about 2 to 6 times the first diameter. This widening is sudden, i.e. it extends over a distance of less than the second diameter.

The discharge electrode 10 thus comprises:

- a downstream end 10-1 in the shape of a tip, positioned facing the collection electrode 20;
- a first part having a first diameter, referred to as the slender part, emerging onto said downstream end 10-1;
- a second part having a second diameter, adjacent to the first part, the second diameter being greater than or equal to twice the first diameter, the second diameter preferably being between 2 and 6 times the first diameter; and
- a widening 11 extending between the first part and the second part, over a distance of less than the second diameter.

The first part and the second part of the discharge electrode 10 are positioned along the same axis, preferably the z-axis of the collection chamber. The tip-shaped downstream end 10-1 of the discharge electrode 10, along the extension of the first part, is free.

One advantage of such a discharge electrode is connected to the fact that it is used to obtain a more axisymmetric deposition of particles on the collection electrode, in relation to a discharge electrode with a constant diameter throughout its length. Such a discharge electrode prevents inhomogeneous accumulations of particles collected at the collection electrode, such accumulations being capable of deteriorating device operation, in particular by reducing the collection efficiency. Moreover, it has been observed that the use of such a discharge electrode reduces the variations in amplitude of the corona discharges. This results in reduced variations of the collection efficiency of the electrostatic collector as it is being used.

In order to illustrate the dimensions, the first diameter can be between 0.5 and 2 mm, preferably between 0.5 and 1 mm. The discharge electrode 10 widens, for example, at a distance of greater than or equal to 1 mm from its downstream end 10-1, for example at a distance of about 5 mm from its downstream end 10-1.

The widening of the discharge electrode 10 can be formed by a conducting ring surrounding the slender part of the discharge electrode over a part of its length. At least the downstream end of the slender part of the discharge electrode protrudes from the ring. Therefore, the discharge electrode 10 comprises a cylindrical ring positioned at a distance of about 1 to 10 mm from the downstream end 10-1, this ring extending along the same axis as the discharge electrode. Preferably, the inner diameter of the ring corresponds to the first diameter, and its outer diameter corresponds to the second diameter. Therefore, the ring is inserted such that it is in contact with the slender part of the discharge electrode. The distance over which this ring extends varies from several mm to several cm.

In order to illustrate the dimensions, the ring can have an outer diameter of between 1 mm and 5 mm and an inner diameter allowing for the passage and support of the slender part of the discharge electrode 10. The slender part of the discharge electrode 10 can protrude from the ring over a distance of between 1 mm and 10 mm downstream of the ring.

The part of the discharge electrode between the widening 11 and the downstream end 10-1 corresponds to the slender part of the electrode. Its diameter is less than about 2 mm, preferably less than about 1 mm. The slender part of the discharge electrode 10 is, for example, formed from a hollow electrically conducting element, for example a metal capillary tube. The metal capillary tube has, for example, an outer diameter of about 0.5 mm and an inner diameter of about 0.25 mm. According to an alternative embodiment, the slender part of the discharge electrode 10 is formed from a solid electrically conducting element.

Figure 2:
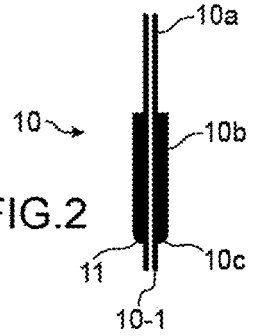
FIG. 2 is a cross-sectional view illustrating in a schematic manner one example of a discharge electrode.

FIG. 2 is a cross-sectional view illustrating in a schematic manner one example of such a discharge electrode capable of being used in an electrostatic collector of the type illustrated in FIG. 1. This discharge electrode is formed from a metal capillary tube 10*a*, surrounded over part of its length by a metal ring 10*b*. The capillary tube 10*a* and the ring 10*b* are, for example, connected to each other by a weld. The end 10*c* of the ring 10*b*, through which passes and from which protrudes the downstream end 10-1 of the discharge electrode 10, intended to be positioned the closest to the collection electrode, is rounded. This prevents any tip-shaped effect. This rounded shape can be produced by a weld.

For the purposes of illustration, the discharge electrode 10 is formed from a metal capillary tube 10*a* having an outer diameter of about 0.5 mm and an inner diameter of about 0.25 mm, surrounded over a part of its length by a metal ring 10*b* having an outer diameter of about 2 mm and an inner diameter of about 0.5 mm. The capillary tube 10*a* emerges from the ring 10*b*, for example at about 5 mm from the downstream end 10-1 of the discharge electrode 10.

According to an alternative embodiment, the discharge electrode 10 can be formed in one piece, machined so as to have a slender end, i.e. with a diameter of less than about 2 mm, preferably less than about 1 mm, and a widening as described hereinabove.

In order to illustrate the materials, the slender part 10*a* of the discharge electrode is preferably made from a metallic material, for example steel or stainless steel, copper, or silver. The conducting ring 10*b* is preferably made from a metallic material, for example steel or stainless steel, copper, or silver.

Collection Electrode:

Preferably, the collection electrode 20 does not have any protrusions or asperities or any square edges facing the discharge electrode. The collection electrode 20 has a surface that is smooth to the touch, i.e. the surface of the collection electrode has a roughness parameter Ra of less than about 0.7 μm, preferably of less than about 0.4 μm. Preferably, the collection electrode 20 has a perfectly polished surface, i.e. the surface of the collection electrode has a roughness parameter Ra of less than about 0.2 μm.

Preferably, the collection electrode 20 is in a metallic material, it is for example made from aluminium. According to an alternative embodiment, the collection electrode 20 is made from a conducting material other than a metallic material, for example from stainless steel or at least from a conducting polymer.

Figure 3A:
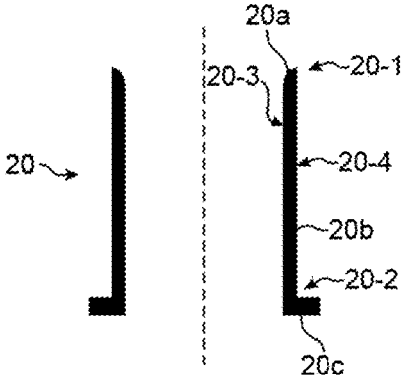
FIG. 3A is a cross-sectional view illustrating in a schematic manner one example of a collection electrode.
Figure 3B:
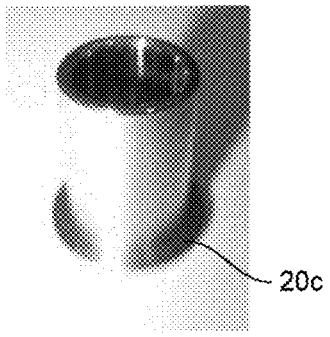
FIG. 3B is a photograph corresponding to the diagram in FIG. 3A.

FIG. 3A is a cross-sectional view illustrating in a schematic manner one example of a collection electrode capable of being used in an electrostatic collector of the type illustrated in FIG. 1. FIG. 3B is a photograph corresponding to the diagram in FIG. 3A.

The collection electrode 20 comprises a main portion 20*b* that is cylindrical in shape. The reference 20-3 designates the inner wall of the collection electrode 20, intended to form the particle collection surface, and the reference 20-4 designates the outer wall of the collection electrode 20. In this example, the outer wall 20-4 and the inner wall 20-3 of the collection electrode 20 are cylindrical.

The upstream end 20-1 of the collection electrode 20 intended to be positioned the closest to the discharge electrode 10 has a rounded inner edge 20*a*. Therefore, when positioned in the wall 1 of the collection chamber, the collection electrode 20 does not have any square edges facing the discharge electrode 10. This reduces the risk of generating electric arcs between the discharge electrode 10 and the collection electrode 20.

The downstream end 20-2 of the collection electrode 20 intended to be positioned the furthest away from the discharge electrode 10 comprises an outer edge 20*c* in the shape of a flange.

Figure 4:
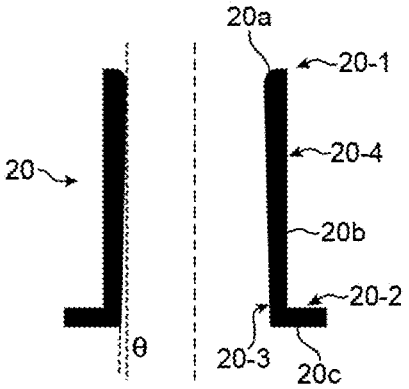
FIG. 4 is a cross-sectional view illustrating in a schematic manner one alternative embodiment of the collection electrode in FIG. 3A.

FIG. 4 is a cross-sectional view illustrating in a schematic manner one alternative embodiment of the collection electrode in FIG. 3A. Elements common to those in FIG. 3A are illustrated with the same reference numbers.

According to this alternative embodiment, the inner diameter of the collection electrode is not constant. The inner wall 20-3 of the collection electrode 20 widens from the upstream end 20-1 to the downstream end 20-2, and the outer wall 20-4 is cylindrical. The inner wall 20-3 of the collection electrode 20 corresponds, for example, to a portion of a cone. The angle of inclination θ of the inner wall 20-3 in relation to the axis of revolution of the collection electrode 20 is, for example, between about 1° and about 10°.

Figure 5:
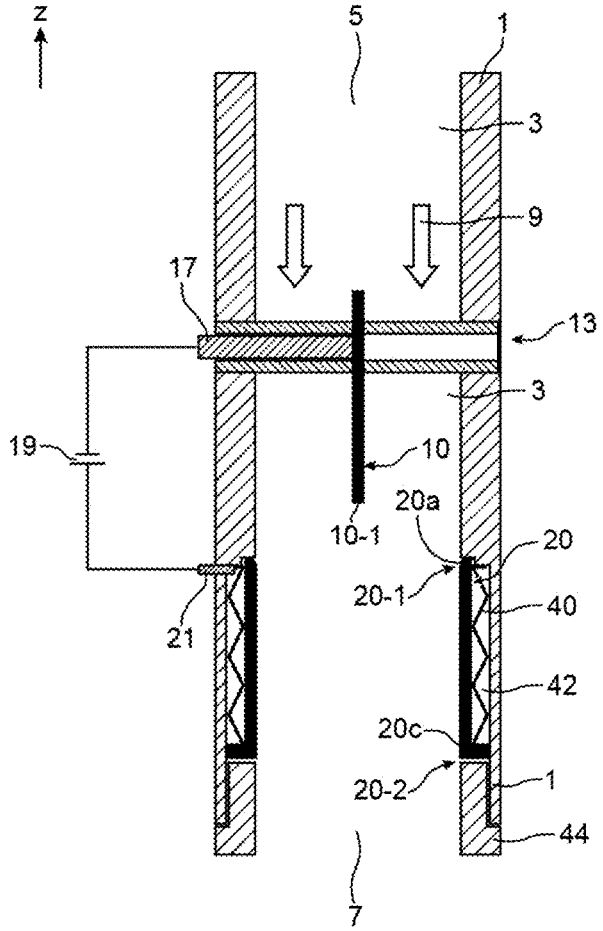
FIG. 5 is a cross-sectional view illustrating in a schematic manner another example embodiment of an electrostatic collector.

FIG. 5 is a cross-sectional view illustrating in a schematic manner another embodiment of an electrostatic collector. Elements common to those in FIG. 1 are illustrated with the same reference numbers and are not described again hereafter.

In this embodiment, the collection electrode 20 is removable, capable of being manually inserted into the electrostatic collector and capable of being manually removed therefrom. It can then be inserted into an analysis device and/or into a cleaning device that is external to the electrostatic collector.

An opening 42, formed in the wall 1 of the collection chamber, is designed to receive the collection electrode 20 and a return means 40, for example a spring, positioned inside the opening 42 between the collection electrode 20 and the wall 1. The inner diameter of the collection electrode 20 substantially corresponds to the inner diameter of the wall 1. The opening 42 is made so that no part of the return means 40 is closer to the discharge electrode 10 than the collection electrode 20.

The downstream end 20-2 of the removable collection electrode 20 comprises a flange 20*c* forming a bearing surface for the return means 40. A locking part 44 is intended to be positioned against the flange 20*c* in order to lock it pressed against the return means 40.

The return means 40 is preferably made from an electrically conducting material, for example stainless steel. In this case, the return means 40 is intended to be electrically connected to the polarising means 21 in order to polarise the collection electrode 20.

In order to insert and hold the collection electrode 20 inside the electrostatic collector, the locking part 44 is positioned against the flange 20*c* of the collection electrode 20. The locking part 44 locks the flange 20*c* pressed against the return means 40, which compresses the latter. The return means 40 rests against both the wall 1 of the collection chamber and the collection electrode 20.

In order to remove the collection electrode 20 from the electrostatic collector, the locking part 44 is removed. The return means 40 then pushes the collection electrode 20 out of the opening 42, which eases the removal of the collection electrode from the electrostatic collector.

One advantage of an electrostatic collector of the type described with reference to FIG. 5 lies in the fact that it allows the collection electrode to be easily removed from the electrostatic collector, for example in order to analyse the particles collected and/or clean the collection electrode.

Figure 6:
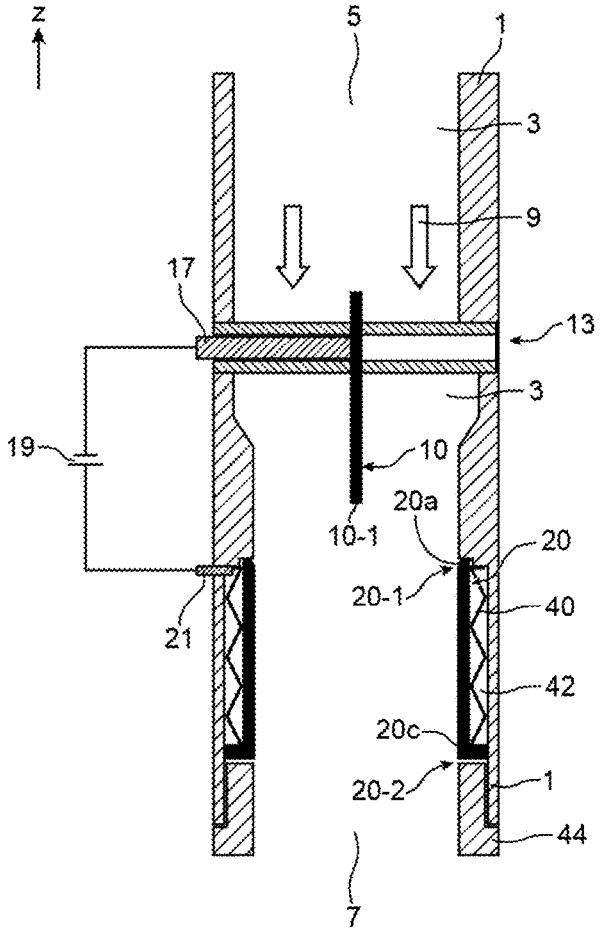
FIG. 6 is a cross-sectional view illustrating in a schematic manner one alternative embodiment of the electrostatic collector in FIG. 5.

FIG. 6 is a cross-sectional view illustrating in a schematic manner one alternative embodiment of the electrostatic collector in FIG. 5. Elements common to those in FIG. 5 are illustrated with the same reference numbers and are not described again hereafter.

In this alternative embodiment, the collection chamber 3 has an inner diameter that is greater upstream of the collection electrode 20 than at the location of the collection electrode. This results in reduced load loss of the device.

The factor by which the diameter of the collection chamber 3 is reduced in an upstream to downstream direction is, for example, equal to about 30 to 50%. The diameter narrowing is preferably formed near to the downstream end 10-1 of the discharge electrode 10, upstream of the downstream end 10-1, for example at a distance substantially corresponding to the inner diameter of the collection electrode.

Between the downstream end 10-1 of the discharge electrode 10 and the collection electrode 20, the wall 1 of the collection chamber has an inner diameter substantially equal to the inner diameter of the collection electrode 20.

A discharge electrode of the type illustrated in FIG. 2 could evidently be used in an electrostatic collector of the type illustrated in FIGS. 5 and 6. Moreover, a collection electrode of the type illustrated in FIG. 4 could be used in an electrostatic collector of the type illustrated in FIGS. 5 and 6.

In an electrostatic collector of the type described with reference to FIGS. 1, 5 and 6 in operation, the voltage generator is capable of imposing an electric potential difference between the collection electrode and the discharge electrode of between about 1 kV and about 15 kV, preferably between about 6 kV and about 10 kV.

Advantageously, the discharge electrode and the collection electrode are polarised such that the electric potential of the discharge electrode is less than the electric potential of the collection electrode. In this case, the electric discharge is said to be negative.

Advantageously, the discharge electrode 10 is connected to the chassis ground and the potential of the collection electrode 20 is positive.

The inventors have conducted collection efficiency measurements according to the diameter of the particles. These measurements have allowed them to observe that, regardless of the diameter of the particles considered, the collection efficiency is optimised for a negative discharge and for a discharge electrode connected to the ground.

In order to conduct these measurements, the inventors passed ambient air containing natural dust into the collection chamber 3. At the outlet of the collection chamber, the processed air was sampled using a derivation positioned downstream of the collection electrode 20. An optical particle counter of the type Dust Monitor v1.109 by Grimm was then used to analyse the air sample. This allowed us to determine the concentration of particles in the air sample according to their diameter and deduce therefrom the collection efficiency according to the diameter of the particles.

The measurements were conducted with a collection chamber having an inner diameter of about 10 mm, and for a distance of about 6 mm between the discharge electrode 10 and the collection electrode 20.

Figure 7:
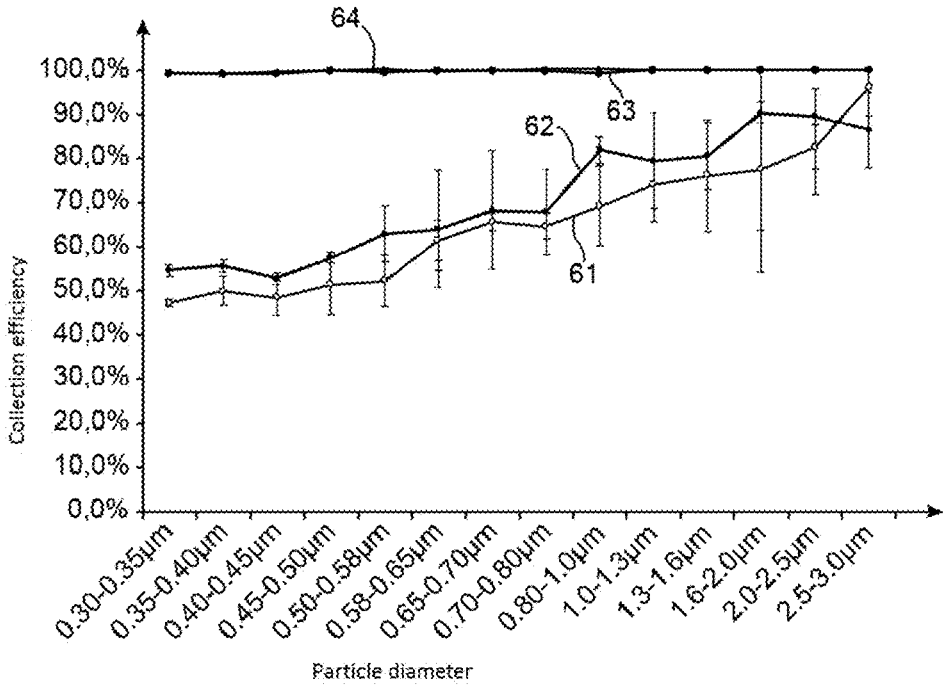
FIG. 7 shows the collection efficiency measurement results according to the diameter of the particles, for different polarisations of the discharge electrode and the collection electrode.

FIG. 7 shows the collection efficiency measurement results according to the diameter of the particles, for different polarisations of the discharge electrode and the collection electrode and for an air flow of 5 liters per minute.

Curves 61 and 62 correspond to a positive discharge, the potential of the discharge electrode being 9 kV and 9.9 kV respectively, the collection electrode being connected to the ground. Curves 63 and 64 correspond to a negative discharge, the potential of the collection electrode being 9 kV and 9.9 kV respectively, the discharge electrode being connected to the ground.

These results show that, for all particle sizes considered, the collection efficiency is optimised when the discharge is negative.

Figure 8A:
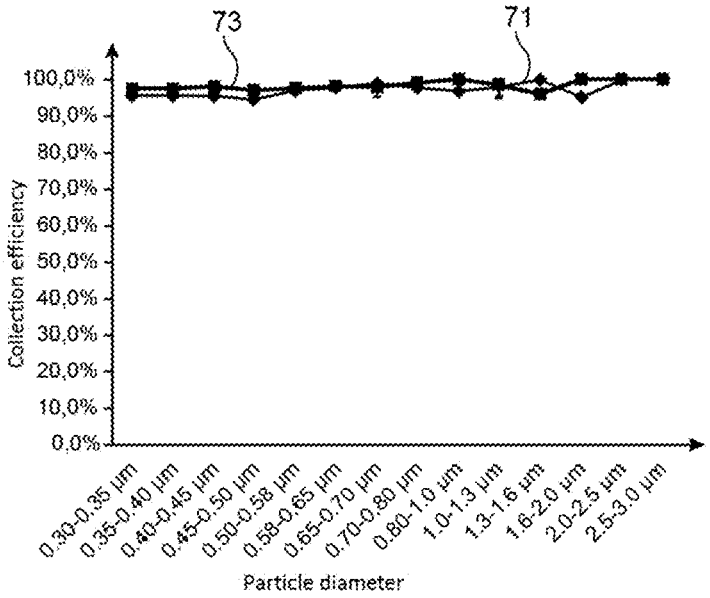
FIGS. 8A and 8B show the collection efficiency measurement results according to the diameter of the particles in the case of a negative discharge, respectively when the discharge electrode is connected to the ground and when the collection electrode is connected to the ground.
Figure 8B:
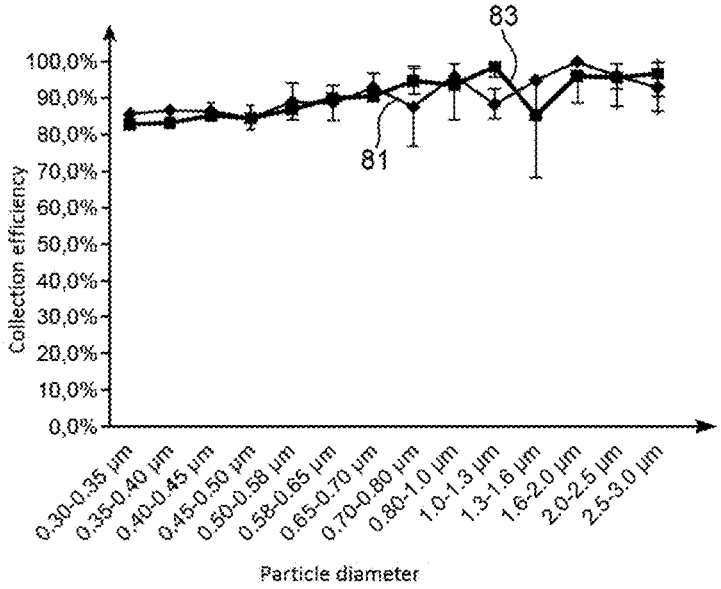

FIGS. 8A and 8B show the collection efficiency measurement results according to the diameter of the particles in the case of a negative discharge, respectively when the discharge electrode is connected to the ground and when the collection electrode is connected to the ground. The measurements were conducted for a negative discharge of 9.9 kV.

Curves 71 and 81 respectively correspond to the case in which the discharge electrode is connected to the ground and the case in which the collection electrode is connected to the ground. Curves 73 and 83 respectively correspond to the case in which the discharge electrode is connected to the earth ground and the case in which the collection electrode is connected to the earth ground (case in which the chassis ground is connected to the earth ground).

These results show that, for all particle sizes considered, in the case of a negative discharge, the collection efficiency is optimised when the discharge electrode is connected to the ground. The inventors observed that these results apply even if the discharge electrode does not comprise any sudden widening as previously described, in particular when the diameter of the collection chamber is less than 50 mm, and preferably less than 30 mm, provided that the discharge electrode extends along the longitudinal axis of the collection chamber.

The invention claimed is:

1. An electrostatic collector comprising:

a collection chamber delimited by a tubular wall made from an electrically insulating material and oriented along a first axis;

a collection electrode configured to be disposed inside the collection chamber in an opening formed in the wall;

a discharge electrode, of elongate form, extending along the first axis comprising:

an end, in a shape of a tip, the end being disposed on a downstream end of the discharge electrode on the first axis;

a first part of a first diameter, emerging on the end, a second part of a second diameter, the second diameter being greater than or equal to at least twice the first diameter; and a sudden widening, extending between the first part and the second part, wherein a potential difference is applied between the collection electrode and the discharge electrode such that particles are collected on a surface of the collection electrode.

2. The electrostatic collector according to claim 1, wherein the sudden widening extends over a distance that is less than the second diameter.

3. The electrostatic collector according to claim 1, further comprising:

a first electric conducting part to connect the discharge electrode to a first potential; and a second electric conducting part to connect the collection electrode to a second potential, wherein the first potential is less than the second potential, or the first potential is a ground potential.

4. The electrostatic collector according to claim 1, wherein the first diameter is between 0.5 mm and 2 mm.

5. The electrostatic collector according to claim 1, wherein the widening of the discharge electrode is formed by a conducting ring surrounding a first slender part of the discharge electrode over a part of a length of the discharge electrode, the first part and the end protruding from the ring.

6. The electrostatic collector according to claim 5, wherein a side of the ring positioned closest to the end is rounded.

7. The electrostatic collector according to claim 5, wherein the end is located at a distance of between 2 mm and 10 mm from the ring.

8. The electrostatic collector according to claim 5, wherein the ring has an outer diameter of between 1 mm and 5 mm and an inner diameter allowing for passage and support of the first slender part of the discharge electrode.

9. The electrostatic collector according to claim 1, wherein the discharge electrode is a hollow electrically conducting element.

10. The electrostatic collector according to claim 1, wherein the discharge electrode and the collection electrode are offset in relation to each other along the first axis of the collection chamber, no portion of the discharge electrode being at a same level as the collection electrode along the first axis.

11. The electrostatic collector according to claim 1, further comprising a return means, wherein the collection electrode is tubular shape and is configured to be positioned inside an opening formed in the wall, the collection electrode having a first end and a second end, the first end configured to be positioned closest to the end of the discharge electrode;

and wherein the return means is configured to be positioned inside the opening between the collection electrode and the wall.

12. The electrostatic collector according to claim 11, wherein the return means is a spring.

13. The electrostatic collector according to claim 11, further comprising a locking part, configured to press against the second end of the collection electrode and compress the return means.

14. The electrostatic collector according to claim 11, wherein the second end of the collection electrode comprises a flange.

15. The electrostatic collector according to claim 11, wherein the first end of the collection electrode comprises a rounded inner edge.

16. The electrostatic collector according to claim 11, wherein an inner wall of the collection electrode is a portion of a cone.

17. The electrostatic collector according to claim 11, where the collection chamber has an inner diameter that is greater upstream of the collection electrode than at the location of the collection electrode.

* * * * *